US005429106A

United States Patent [19]

Martin et al.

[11] Patent Number: 5,429,106

[45] Date of Patent: Jul. 4, 1995

[54] ARCHERY BOW AND LIMB SYSTEM FOR AN ARCHERY BOW

[75] Inventors: Terry G. Martin; George T. Newbold, both of Walla Walla, Wash.

[73] Assignee: Martin Archery, Inc., Walla Walla, Wash.

[21] Appl. No.: 384,474

[22] Filed: Jan. 31, 1995

Related U.S. Application Data

[63] Continuation of Ser. No. 115,281, Aug. 31, 1993, abandoned.

[51] Int. Cl.[6] ..... F41B 5/00

[52] U.S. Cl. ..... 124/23.1; 124/25.6

[58] Field of Search ..... 124/23.1, 25.6; 267/158, 151, 152, 164

[56] References Cited

U.S. PATENT DOCUMENTS 2,818,057 12/1957 Meyer et al. .
3,434,465 3/1969 Stewart .
3,921,598 11/1975 Helmick ..... 124/23.1
4,214,395 7/1980 Caldwell, Jr. ..... 124/23.1
4,644,929 2/1987 Peck ..... 124/23.1
4,671,249 6/1987 Troncoso ..... 124/23.1

*Primary Examiner*—Anthony Knight
*Attorney, Agent, or Firm*—Wells, St. John, Roberts, Gregory & Matkin

[57] ABSTRACT

An archery bow and a limb system for an archery bow includes a distal end piece, a proximal end piece, and a modular working section. The modular working section includes one or more replaceable working section members coupled to the distal end piece and the proximal end piece. The limb system includes working section members comprising various cross-sectional shapes and sizes. The limb system includes various manners of attaching the working section members to the distal end piece and the proximal end piece. The limb system also includes a limb connection system for attaching the working section members directly to the handle riser of an archery bow.

21 Claims, 7 Drawing Sheets

ARCHERY BOW AND LIMB SYSTEM FOR AN ARCHERY BOW

The present application is a continuation of application Ser. No. 08/115,281, filed Aug. 31, 1993, now abandoned.

TECHNICAL FIELD

This invention relates to archery bows and limb systems for archery bows.

BACKGROUND OF THE INVENTION

Over the years, various types of archery bows have been developed, including traditional bows (i.e., long bows and recurve bows) and compound bows. All archery bows include a pair of opposed limbs extending from the handle riser of the bow. As an archer draws the bow by pulling on the bow string, the limbs flex and store energy. This energy is transferred to the arrow as the archer releases the bow string.

Much effort has gone into designing and developing limbs for archery bows, particularly limbs for compound bows. Compound bow limbs have traditionally been made of laminated layers of wood, plastic, fiberglass, and other composite materials. Limb performance depends both on the materials used to make the limb and the manner in which the materials are combined.

Some of the primary goals in designing and engineering bow limbs include increasing the bow limb's efficiency in storing energy and releasing the stored energy, and increasing the life of the bow limb (i.e., the period of time over which the bow limb maintains its ability to store and release energy).

Reducing the weight of the bow limbs is another desired objective of any bow limb design. Many traditional bow limbs are heavy, which adds weight to the bow and decreases bow efficiency. A reduction in the weight of the limb will reduce the overall the bow weight, which will improve the archer's ability to aim and shoot the bow accurately.

Yet another design consideration in bow limb systems relates to the outer ends of the bow limbs, where eccentric wheels or cams are attached through respective axles to the limbs. The outer ends must be sturdy enough to securely hold the wheel or pulley, yet be as light as possible to increase the bow limb efficiency and, correspondingly, arrow speed.

Still another factor in bow limb design relates to the torque applied to the bow limbs by the archer when drawing or releasing the bow string. A suitable bow limb design must substantially reduce, if not eliminate, torquing and twisting of the bow limbs as the archer draws and releases the bow string.

Another consideration in limb design relates to the working section of the limb. This is the portion of the limb that bends when the bow string is drawn to store the energy. The longer the working section, the smoother the bow limb will bend, thereby increasing the efficiency of the bow limb.

Traditional bow limb designs have been largely unsuccessful in overcoming all of the above-mentioned design difficulties. The present invention involving an archery bow and limb system for an archery bow has resulted in dramatic improvements and advancements in archery bow limb designs. The various features, advantages, and objects of the invention will become apparent from the detailed description that follows.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The invention is characterized by a limb system for an archery bow, comprising:

- a proximal end piece attachable to a handle riser of an archery bow;
- a distal end piece configured for attaching a bow string thereto; and
- a modular working section removably secured between the proximal end piece and the distal end piece.

The invention is further characterized by an archery bow, comprising:

a handle riser having opposing ends;

opposing bow limbs coupled to the opposing ends of the handle riser;

a bow string extending between the opposing bow limbs; and at least one of the bow limbs comprising:

a proximal end piece attached to the handle riser;

a distal end piece to which the bow string is attached; and a modular working section removably secured between the proximal end piece and the distal end piece.

Figure 1:
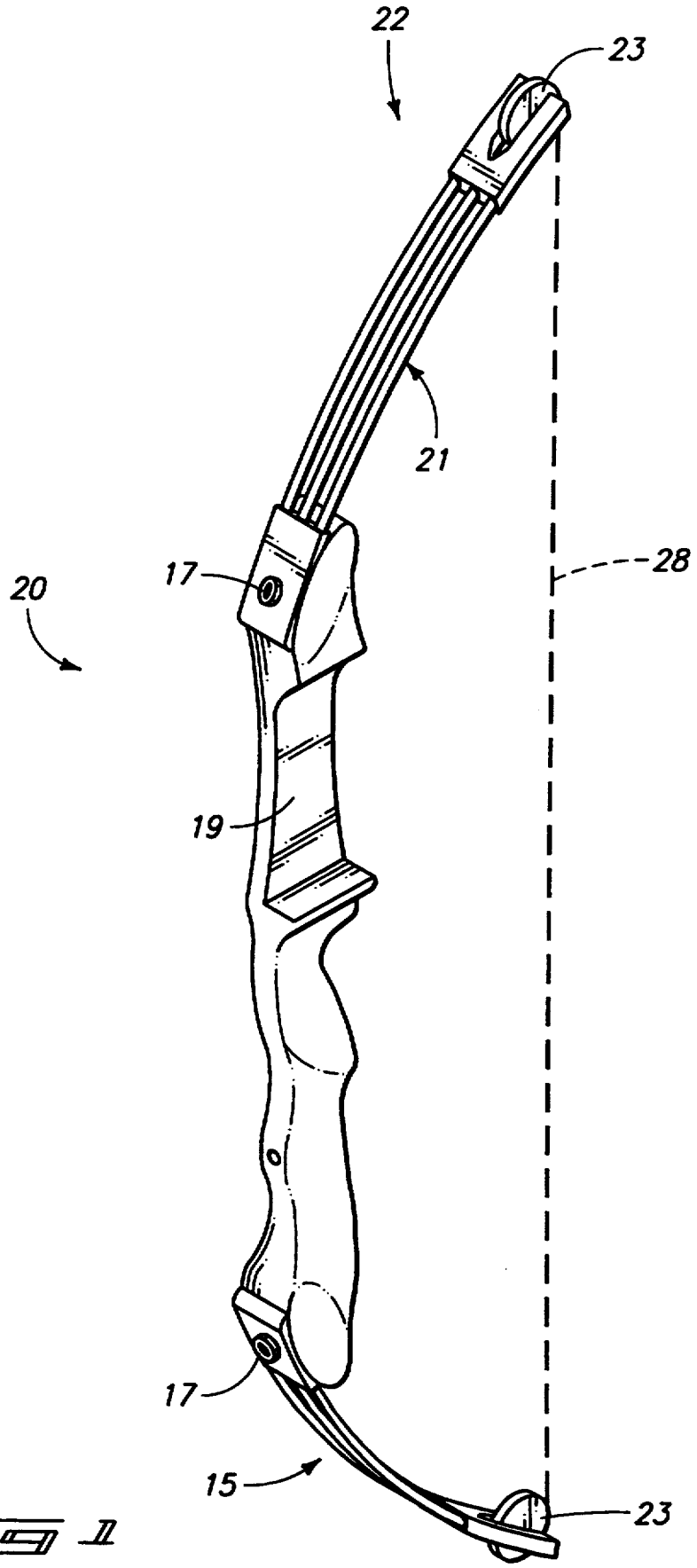
FIG. 1 is an isometric view of an archery bow including a limb system according to the present invention.

FIG. 1 shows an archery bow 20 including a handle riser 19, opposing limb systems 22, 15 and a bow string 28. The bow string is attached to the bow 20 by means of respective eccentric wheels 23 axially coupled to the outer ends of the bow limb systems 22, 15. The limb systems 22, 15 are secured to the handle riser 19 by means of adjustable limb bolts 17.

Figure 2:
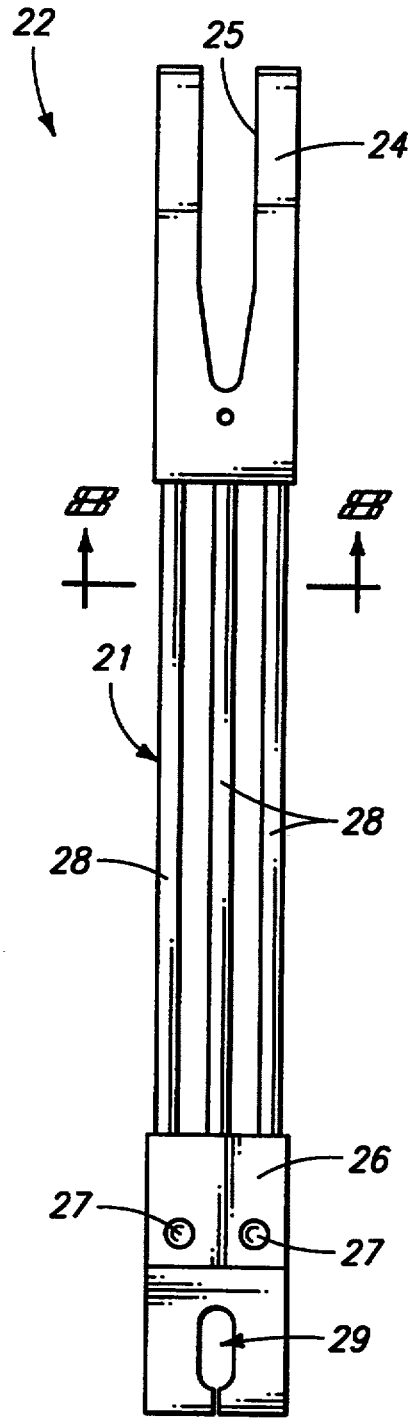
FIG. 2 is a front elevation view of the limb system of FIG. 1.

FIG. 2 illustrates a limb system 22 (the reverse side as compared to FIG. 1) for an archery bow. The limb system 22 includes a proximal end piece 26 securable to a handle riser 19 of a bow (FIG. 1). The proximal end piece defines an elongated slot 29 through which a limb bolt 17 (FIG. 1) is inserted for securing the limb to a handle riser of an archery bow. The proximal end piece includes dished indentations 27 which provide bearing surfaces for corresponding conventional rocker buttons of a handle riser.

The bow limb system 22 further comprises a distal end piece 24 which forms the tip end of the bow limb. An elongated slot 25 is formed in the distal end piece for allowing an eccentric wheel or cam to be pivotally mounted to the limb within the slot.

The bow limb system 22 also includes a modular working section 21 removably secured between the proximal end piece 26 and the distal end piece 24. The modular working section 21 comprises multiple replaceable working section members 28 extending between the proximal end piece and distal end piece. The working section members 28 are individually replaceable and therefore can be removed in favor of working section members with different resistances to bending to increase or decrease the draw weight of the bow. Various working section members can be installed on the bow such that at least two replaceable working section members have different resistances to bending. Although the working section of FIG. 2 shows three working section members 28, it is to be understood that more or less multiple working section members could be used in connection with the present invention.

As compared to traditional limbs for compound archery bows, the working section members 28 may, depending on the material and dimensions of the members, greatly reduce the overall weight of the archery bow without compromising the strength of the working section 21. Reducing the physical weight of a bow is advantageous because it enables the archer to aim and shoot the bow more accurately. Alternatively or in addition, the working section members 28 of the modular working section 21 may consist of customized cross-sectional shapes and sizes, lengths, and stiffnesses to suit virtually any specific need an archer may have.

Figure 8:
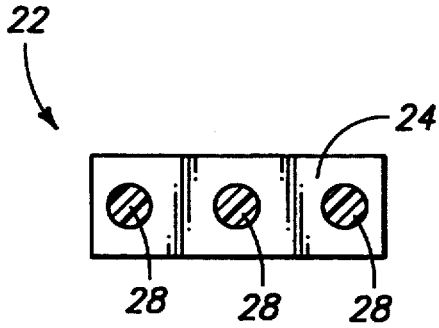
FIG. 8 is a sectional view, taken along the line 8—8, of the bow limb system of FIG. 2.

FIG. 8 shows a sectional view of the archery bow limb system of FIG. 2. In this embodiment, each of the working section members 28 has a circular cross-sectional shape. The replaceable working section members 28 are coupled directly to the proximal end piece 26 and the distal end piece 24. The working section members 28 may be solid (as shown) or hollow, depending on the desired strength characteristics.

The working section members 28 each have opposite ends insertable into respective cavities in the distal end piece 24 and the proximal end piece 26. The cavities are sized to tightly and securely receive the ends of the working section members 28. The members 28 may be secured within the cavities by using adhesives or by other suitable methods, such as a pin connection system (described below in conjunction with FIGS. 11–13).

In the embodiment of FIGS. 1 and 8, the limb system 22 is attached to the handle riser 19 (FIG. 1) of a bow using a limb connection system. This limb connection system involves securing the proximal end piece 26 to the handle riser 19 by inserting an adjustable limb bolt 21 (FIG. 1) through a slot 29 of the proximal end piece 26 (FIG. 2) and into the handle riser 19. The handle riser 19 and the proximal end piece 26 are but one example of a suitable limb connection system.

Figure 3:
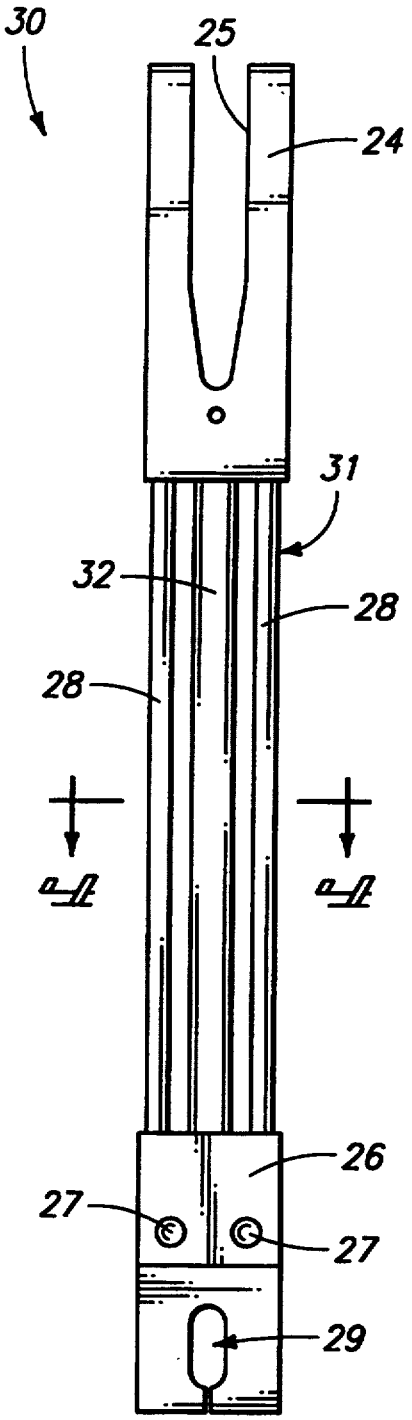
FIG. 3 is a front elevation view of another characterization of a bow limb system according to the present invention.
Figure 4:
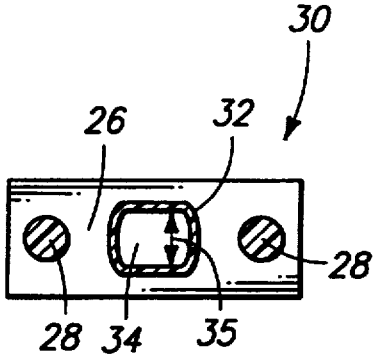
FIG. 4 is a sectional view, taken along the line 4—4, of the limb system of FIG. 3.

FIGS. 3 and 4 show another characterization of the invention, including a bow limb system 30 having a modular working section 31. The modular working section 31 includes plurality of working section members 28 (similar to those described in FIG. 2) and a middle working section member 32. The modular working section members are coupled to a proximal end piece 26 and a distal end piece 24 (similar in function and structure to the proximal and distal end pieces of FIG. 2). The middle member 32 is at least partially hollow, defining an inner chamber 34. The chamber may be filled at least partially with fluid (e.g., a liquid and/or a gas) to absorb vibrations of the bow and quiet the bow when it is shot. Alternatively, the chamber may remain empty to further reduce the weight of the bow while maintaining sufficient strength to satisfy the design characteristics of the limb.

Although the embodiment of FIGS. 3 and 4 show only one of the working section members (the middle member) as having a generally oval or elliptical cross-sectional area, it may be desirable to include two or more working section members with this type of cross-sectional area. Additionally, such working section members, such as middle member 32, could be solid, rather than hollow, depending on the desired strength characteristics of the working section 31.

The limb system 30 includes a bend direction which corresponds, at least in part, to the direction of pull of the bow string 28 (FIG. 1). In the case where working section members have generally oval cross-sectional shapes, each such member will include a small cross-sectional dimension 35. Working section members, similar to member 32, will have less resistance to bending at the small cross-sectional dimension 35. Working section members, similar to member 32, are aligned with their respective small cross-sectional dimensions being perpendicular to the limb bend direction. Aligning the smallest cross-sectional dimension perpendicular to the desired limb bend direction (as with middle member 32 shown in FIG. 4) will minimize the torque effect on the bow limbs when an archer draws or releases the bow string.

Figure 5:
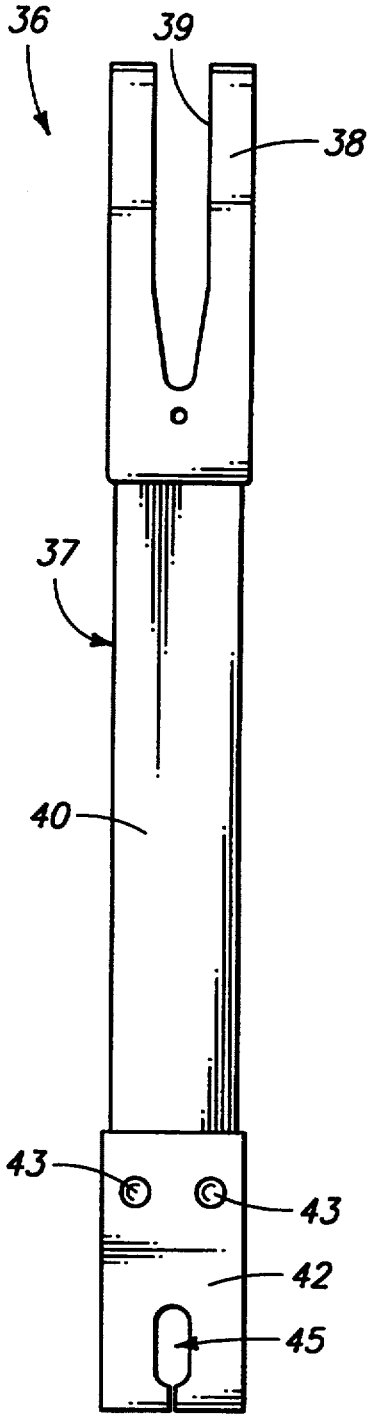
FIG. 5 is a front elevation view of still another characterization of a bow limb system according to the present invention.
Figure 6:
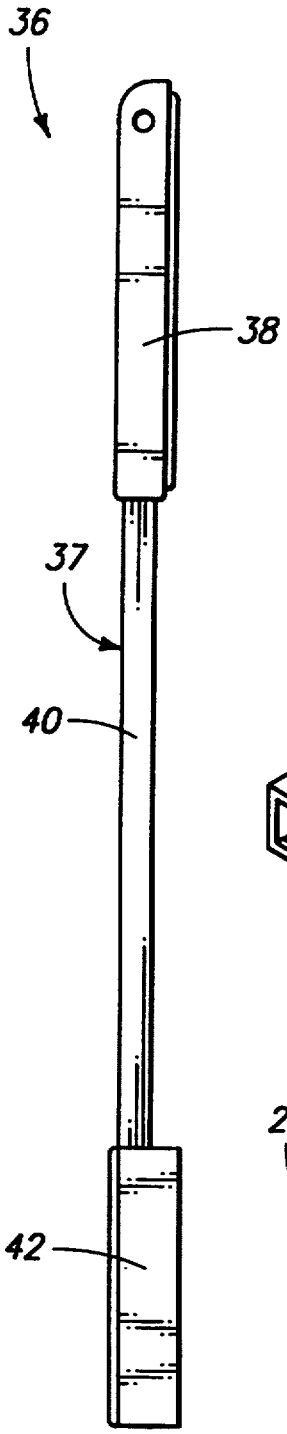
FIG. 6 is a right side elevation view of the bow limb of FIG. 5.

FIGS. 5 and 6 show yet another characterization of a bow limb system 36 according to the present invention. The bow limb system 36 includes a distal end piece 38 and a proximal end piece 42. Dished indentations 43 are provided in the proximal end piece 42 to provide bearing surfaces for corresponding conventional rocker buttons (not shown) of a handle riser.

The proximal end piece 42 of the bow limb system 36 is secured to a bow by means of a limb bolt (not shown) threadedly received by a handle riser (also not shown) through slot 45. The distal end piece 38 includes an elongated slot within which a wheel or other eccentric cam (not shown) is mounted.

Figure 7:
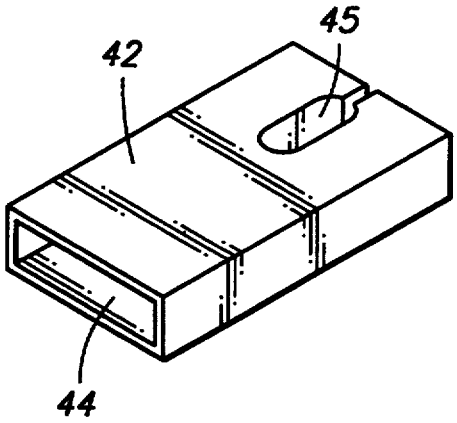
FIG. 7 is an isometric view of an end piece of the bow limb of FIG.5.

The bow limb system 36 includes a modular working section 37 which comprises a single, unitary working section member 40 coupled to the distal end piece 38 and the proximal end piece 42. The working section member 40 may be adhesively secured to the distal end piece 38 and proximal end piece 42, although other conventional fastening means could also be employed. Alternatively, no securing means may be necessary where the bow, being fully assembled, forces the end pieces 38 and 42 into engagement with the working section members 40 to adequately secure the working section members 40 to the end pieces. FIG. 7 shows a perspective view of a preferred proximal end piece 42, which defines a cavity 44 into which an end of the unitary working section member 40 is inserted and secured. The distal end piece 38 is similarly configured.

Figure 9B:
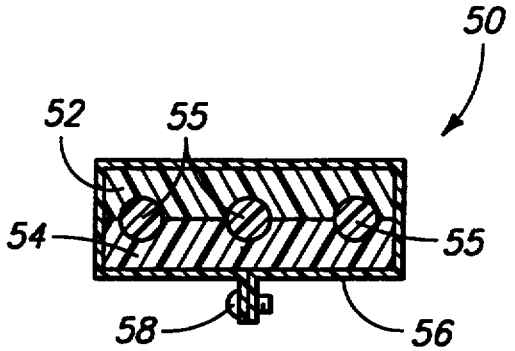
FIG. 9B is a sectional view, taken along the line 9B—9B, of FIG. 9A.
Figure 9A:
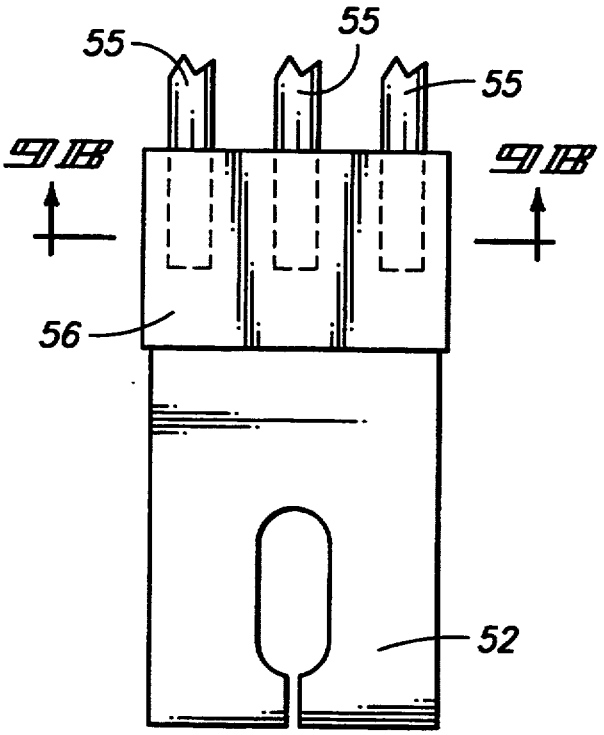
FIG. 9A is a partial front elevation view of an alternative characterization of a bow limb system attachment means according to the present invention.

FIGS. 9A, and 9B illustrate an alternative characterization of a limb connection system, which includes multiple working section members 55, a proximal end piece 52, and a strap 56. The working section members 55 are positioned inside corresponding grooves formed in the proximal end piece 52. A separable connection piece 54 is placed around the working section members 55 opposite the proximal end piece 52. A strap 56 is placed about the proximal end piece 52 and the connection piece 54 to secure the working section members therebetween. The strap is secured in place by a fastener 58. The strap 56 forms but one example of a proximal end piece attachment means for detachably securing the modular working section to the proximal end piece.

Figure 10:
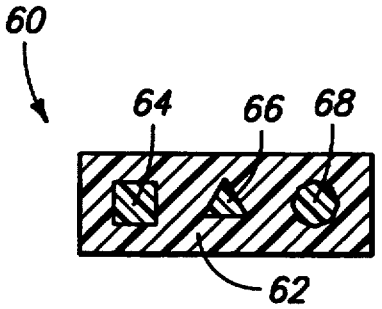
FIG. 10 is a sectional view of yet another characterization of a bow limb system according to the present invention.

FIG. 10 shows various representative cross sectional shapes of working section members that may be utilized in connection with the bow limb system. The replaceable working section members illustrated have different cross-sectional shapes. They include a rectangular cross-sectionally shaped member 64, a triangular cross-sectionally shaped member 66, and an octagonal cross-sectionally shaped member 68. The working section members 64, 66, 68 are inserted into and secured within similarly shaped cavities in the end piece 62. These respective cross sectional shapes could be used in combination with one another, or one cross-sectional shape could be used exclusively in a given bow limb design. Regardless of the particular desired shape to be used, One advantage of using a non-circular cross-sectional shaped member is that the particular working section member will not rotate relative to the end piece in its similarly shaped cavity.

Figure 11:
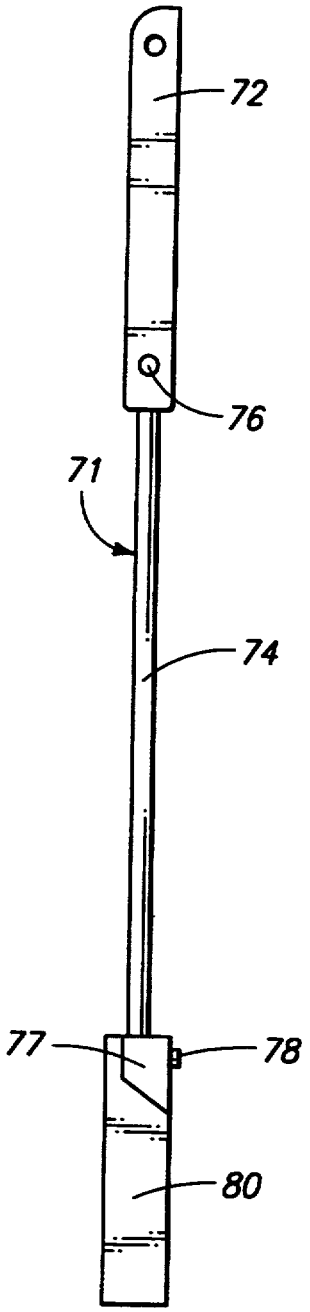
FIG. 11 is a side elevation view of another characterization of a bow limb system according to the present invention.
Figure 12:
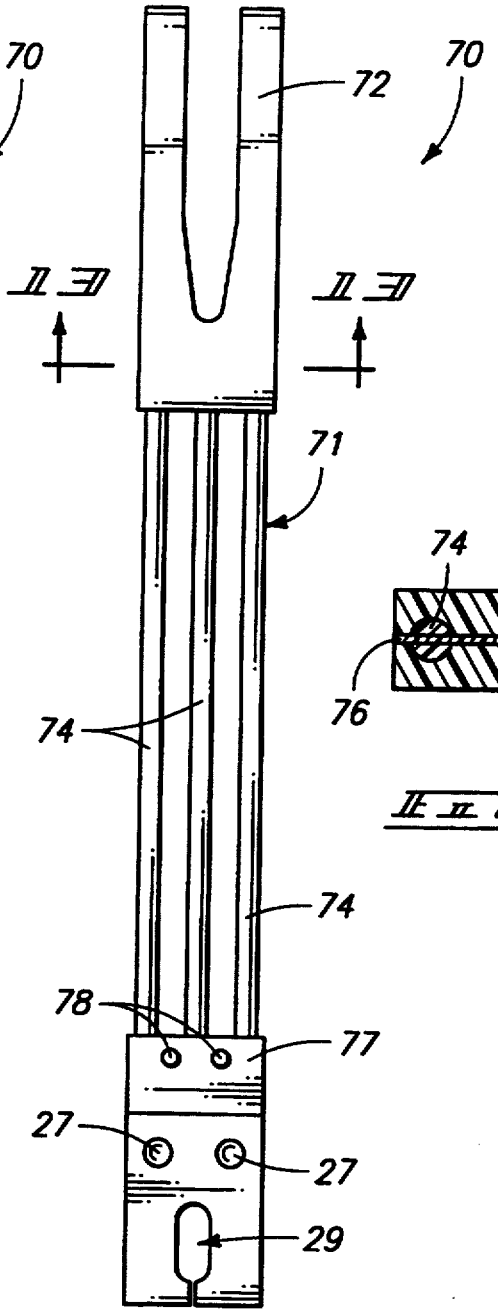
FIG. 12 is a front elevation view of the bow limb system of FIG. 11.
Figure 13:
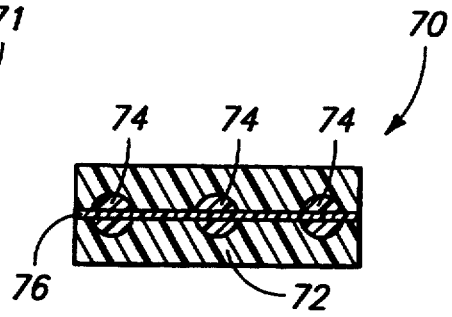
FIG. 13 is a sectional view taken along the line 13—13 in FIG. 12.

FIGS. 11, 12, and 13 show still another characterization of a bow limb system 70 having a modular working section 71. The limb system 70 includes working section members 74 and an alternative means for securing the working section members 74 to a distal end piece 72 and a proximal end piece 80. The working section members 74 are inserted into the distal end piece 72 and secured therein by an attachment means in the form of a connecting pin 76. The connecting pin is inserted through the distal end piece and holes in the working section members.

The connecting pin 76 provides a distal end piece attachment means for detachably securing the modular working section to the distal end piece. The pin fixedly secures the working section members to the distal end piece and prevents rotation of the working section members relative to the distal end piece. A connecting pin, similar to the connecting pin 76, could also be used to secure the modular working section to the proximal end piece.

Referring still to FIGS. 11, 12, and 13, the working section members 74 are coupled to the proximal end piece 80 by means of cover piece 76 and fasteners 78. The cover piece 76 is removably secured to the proximal end piece 80 to allow installation and removal of the working section members 74 relative to the proximal end piece 80. It is to be understood that an alternative fastening means, other than the fasteners 78, could be used to secure the cover piece 76 to the end piece 80.

Figure 14:
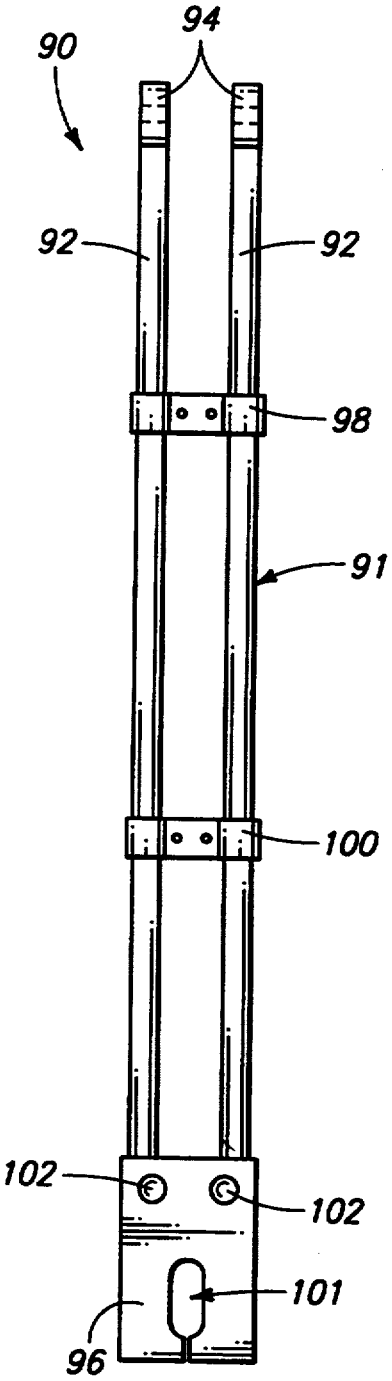
FIG. 14 is a front elevation view of another characterization of a bow limb system according to the present invention.
Figure 15:
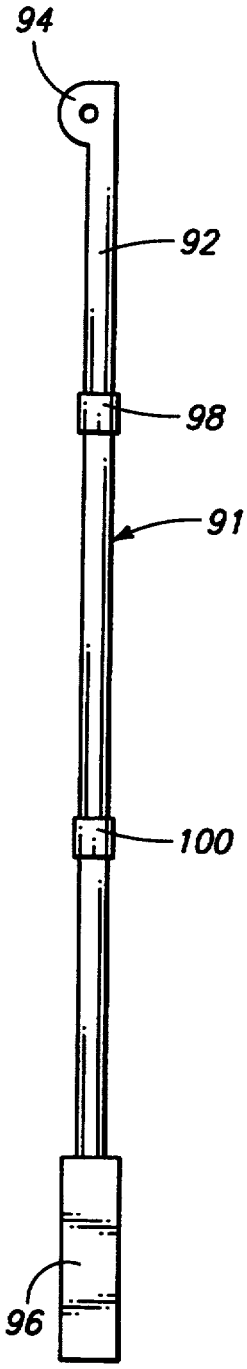
FIG. 15 is a side elevation view of the bow limb system of FIG. 14.

FIGS. 14–15 show another characterization of a bow limb system 90 according to the present invention. The bow limb system 90 has a modular working section 91, which includes multiple replaceable working section members 92 secured to a proximal end piece 96. The proximal end piece includes a pair of dished bearing surfaces 102 for engagement with rocker buttons of a handle riser (FIG. 1). The end piece 96 further defines a slot 101 for receiving an adjustable limb bolt (FIG. 1). The working section members 92 have a distal end configured for rotatably mounting an eccentric wheel or the like (not shown) for attaching a bow string thereto.

A first clasp 98 and a second clasp 100 interconnect the replaceable working section members. The clasps are mounted at preferred locations relative to the working section members. The mounting locations of the clasps may, however, be adjusted by sliding the clasps along the lengths of the respective working section members. The clasps serve to prevent the working section members from twisting relative to the handle riser (not shown) when drawing or releasing the bow string. This limb design is further desirable because of the substantial weight reduction at the outer end of the limb, which will increase the efficiency of the bow limb.

Figure 16:
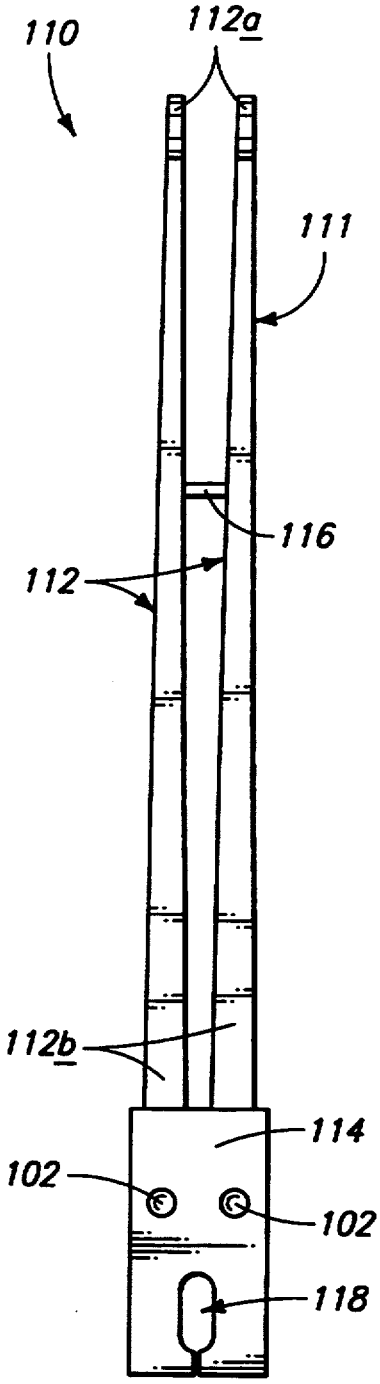
FIG. 16 is still another characterization of a bow limb system according to the present invention.

FIG. 16 shows still another characterization of a bow limb system 110 according to the present invention. The limb system 110 includes a modular working section 111 having multiple working section members 112 secured to a proximal end piece 114. The working section members 112 are inserted into and secured within corresponding cavities of the proximal end piece 114. The end piece 114 includes a pair of conventional dished bearing surfaces 102 for engagement with rocker buttons (not shown), and a slot 118 for receiving an adjustable limb bolt (FIG. 1). The respective working section members 112 are cross-sectionally tapered from one end to another to provide differing resistances to bending at various points along the respective lengths of the working section members. The tapered cross-sectional dimensions of the working section members increase the effective length of the working section of the limb as the bow is drawn, which in turn increases bow efficiency and performance. A pin 116 or other suitable connection means may be used to interconnect the working section members 112 to prevent limb torque.

Figure 17:
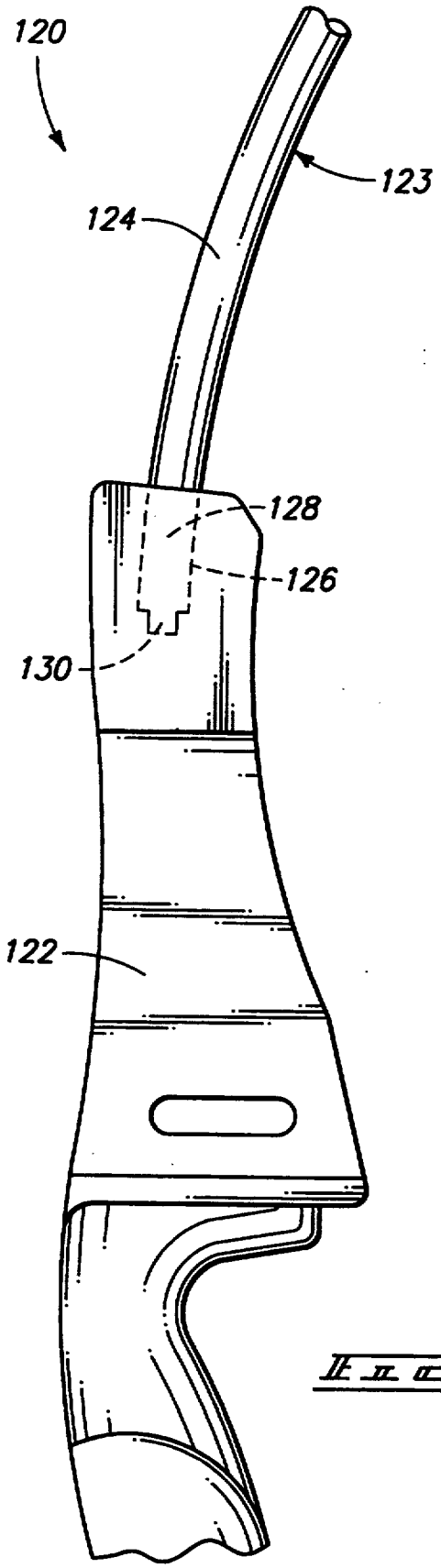
FIG. 17 is a partial side view of an archery bow including another characterization of the limb system of the present invention.
Figure 18:
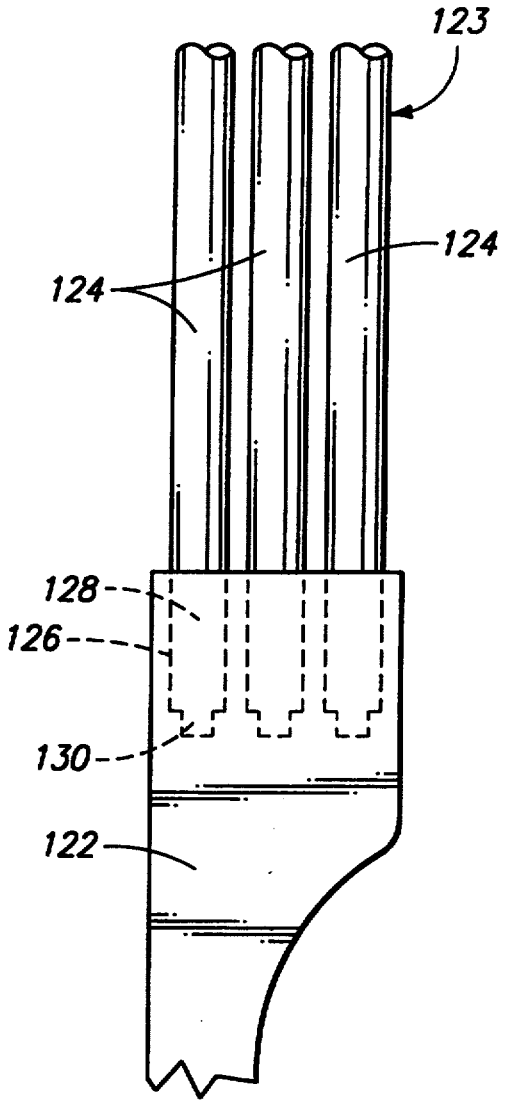
FIG. 18 is a partial front elevation view of the archery bow and limb system of FIG. 17.

FIGS. 17 and 18 show yet another characterization of a bow limb system 120 according to the present invention. The limb system 120 has a modular working section 123 which includes multiple working section members 124 coupled directly to a handle riser 122 of an archery bow by means of a limb connection system. The limb connection system involves a handle riser having multiple cavities 126, and proximal ends 128 of the working section members 124 corresponding in size and shape to the cavities 126. The proximal ends 128 include respective extension portions 130 which seat into corresponding sockets of the cavities 126. The working sections 124 may be secured to the handle riser 122 by an adhesive, a pin connection system (similar to FIGS. 11 and 12), or another suitable means.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A limb system for an archery bow, comprising:

a proximal end piece attachable to a handle riser of an archery bow;

a distal end piece, the distal end piece being configured to receive an axle and eccentric wheel; and a modular working section removably secured to each of the proximal end piece and the distal end piece.

2. A limb system for an archery bow according to claim 1 wherein the modular working section comprises multiple replaceable working section members wherein at least two of the replaceable working section members have different cross-sectional shapes, the working section members being spaced from one another by a fixed distance.

3. A limb system for an archery bow according to claim 1 wherein the modular working section comprises at least one replaceable working section member having a circular cross-sectional shape.

4. A limb system for an archery bow according to claim 1 wherein the modular working section comprises at least one working section member having a generally oval cross-sectional shape.

5. A limb system for an archery bow according to claim 1 wherein the modular working section comprises at least one working section member having a generally oval cross-sectional shape which includes a small cross-sectional dimension, the working section member having the least resistance to bending at its small cross-sectional dimension.

6. A limb system for an archery bow according to claim 1 wherein the limb has a bend direction, the modular working section comprising at least one working section member having a generally oval cross-sectional shape which includes a small cross-sectional dimension, the working section member having the least resistance to bending at its small cross-sectional dimension, the working section member being aligned with the small cross-sectional dimensions perpendicular to the limb bend direction.

7. A limb system for an archery bow according to claim 1 wherein the modular working section includes a replaceable working section member, the replaceable working section member being at least partially hollow.

8. A limb system for an archery bow according to claim 1 further comprising a connecting pin insertable through the proximal end piece to secure the modular working section to the proximal end piece.

9. A limb system for an archery bow according to claim 1 wherein the modular working section comprises multiple replaceable working section members, and further comprising a clasp interconnecting the spaced, replaceable working section members along their respective working section lengths.

10. A limb system for an archery bow according to claim 1, further comprising a strap to secure the modular working section to the proximal end piece.

11. A limb system for an archery bow according to claim 1 wherein the modular working section includes a longitudinal internal cavity.

12. A limb system for an archery bow, comprising:

a proximal end piece attachable to a handle riser of an archery bow;

a distal end piece configured for attaching a bow string thereto;

a modular working section removably secured between the proximal end piece and the distal end piece; and wherein the modular working section includes a replaceable working section member, the replaceable working section member being at least partially hollow and filled at least partially with liquid.

13. A limb system for an archery bow, comprising:

a proximal end piece attachable to a handle riser of an archery bow;

a distal end piece configured for attaching a bow string thereto; and a modular working section removably secured between to each of the proximal end piece and the distal end piece;

wherein the modular working section comprises multiple, spaced, replaceable working section members, the respective working section members being cross-sectionally tapered in all sectional directions from one end to another to provide differing resistances to bending at various points along the respective lengths of the working section members.

14. A limb system for an archery bow, comprising:

a proximal end piece securable to a handle riser of an archery bow, the proximal end piece having at least one cavity;

a distal end piece;

a modular working section including at least two working section members having respective proximal and distal ends, the proximal ends of the working sections being insertable into the at least one cavity to connect the respective proximal ends of the working section members to the proximal end piece, the distal ends of the working section members being insertable into and mountable within the distal end piece; and means for connecting a bow string to the distal end piece.

15. An archery bow incorporating the limb system as recited in claim 14.

16. A limb system for an archery bow according to claim 14 wherein the modular working section includes three working section members.

17. An archery bow, comprising:

an elongated handle riser having opposing longitudinal ends, at least one of the ends having at least one longitudinally elongated opening formed longitudinally therein;

opposing bow limbs coupled to the handle riser, at least one of the bow limbs comprising at least one working section member having opposing longitudinal ends, one of the working section member opposing longitudinal ends being received within the handle riser longitudinal opening, said one bow limb further comprising a distal end piece, the distal end piece being configured to receive an axle and eccentric wheel and the opposing longitudinal end of the working section member; and a bow string spanning the bow limbs.

18. An archery bow according to claim 17 wherein the one handle riser end has a plurality of longitudinally elongated openings formed longitudinally therein, the one bow limb having a plurality of working section members respectively received within the riser longitudinal openings.

19. An archery bow according to claim 18 wherein at least two of the plurality of working section members comprise different cross-sectional shapes.

20. An archery bow according to claim 17 wherein the one spaced working section member is hollow.

21. An archery bow, comprising:

a handle riser having a limb connection system;

opposing bow limbs coupled to the handle riser, at least one of the bow limbs comprising multiple working section members and a distal end piece, the working section members being secured to the handle riser through the limb connection system;

a bow string coupled to the distal end piece; and wherein at least one of the working section members is a hollow, replaceable member, the replaceable member being filled at least partially with liquid.

* * * * *